US006749296B2

(12) United States Patent
Usui et al.

(10) Patent No.: US 6,749,296 B2
(45) **Date of Patent: *Jun. 15, 2004**

(54) INK JET RECORDING APPARATUS

(75) Inventors: Minoru Usui, Nagano (JP); Noriaki Okazawa, Nagano (JP); Satoru Hosono, Nagano (JP); Tomoaki Takahashi, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/242,490

(22) PCT Filed: Jun. 29, 1998

(86) PCT No.: PCT/JP98/02898

§ 371 (c)(1),
(2), (4) Date: May 13, 1999

(87) PCT Pub. No.: WO99/01285

PCT Pub. Date: Jan. 14, 1999

(65) Prior Publication Data

US 2002/0109762 A1 Aug. 15, 2002

(30) Foreign Application Priority Data

Jul. 2, 1997 (JP) ..... P. 9-191918
Feb. 16, 1998 (JP) ..... P. 10-050101

(51) Int. Cl.[7] ..... B41J 2/175
(52) U.S. Cl. ..... 347/93
(58) Field of Search ..... 347/85–87, 92, 347/93

(56) References Cited

U.S. PATENT DOCUMENTS

| | | | | |
|---|---|---|---|---|
| 4,368,478 A | | 1/1983 | Koto | 347/86 |
| 5,457,485 A | | 10/1995 | Moriyama et al. | 347/92 |
| 5,659,345 A | | 8/1997 | Altendorf | 347/87 |
| 5,812,165 A | * | 9/1998 | Boyd et al. | 347/87 |
| 5,821,965 A | * | 10/1998 | Oda et al. | 347/86 |

FOREIGN PATENT DOCUMENTS

| | | | |
|---|---|---|---|
| EP | 529 879 | * 3/1993 | |
| EP | 0 596 252 | 5/1994 | B41J/2/175 |
| EP | 0 609 863 | 8/1994 | B41J/2/175 |
| EP | 0 887 190 | 12/1998 | B41J/2/19 |
| JP | 63-15915 | 4/1988 | B41J/3/04 |
| JP | 2650944 | 5/1997 | |
| JP | 9-267494 | 10/1997 | |

OTHER PUBLICATIONS

Patent Abstracts of Japan, vol. 017, No. 507 (M–1479) Sep. 13, 1993 & JP 05 131645 A (Seiko Epson Corp) May 28, 1993 *Abstract.
Patent Abstracts of Japan, vol. 016, No. 335 (M–1283) Jul. 21, 1992 & JP 04 099634 A (Seikosha Co Ltd) Mar. 31, 1992 *Abstract.
Patent Abstracts of Japan vol. 097, No. 010, Oct. 31, 1997 & JP 09 141890 A (Seiko Epson Corp) Jun. 3, 1997 *Abstract.
Patent Abstracts of Japan, vol. 097, No. 008, Aug. 29, 1997 & JP 09 109409 A (Ricoh Co Ltd) Apr. 28, 1997 *Abstract.

* cited by examiner

*Primary Examiner*—Michael Nghiem
(74) *Attorney, Agent, or Firm*—Sughrue Mion, PLLC

(57) ABSTRACT

Grooves 21 are formed in the side of an ink supply needle 17 opposite a filter 19 in order to induce the movement of ink using capillary attraction, and so that the grooves 21 ensure that ink can flow along a path to a recording head regardless of whether an air bubble is present.

31 Claims, 13 Drawing Sheets

FIG. 8 III

INK JET RECORDING APPARATUS

FIELD OF THE INVENTION

The present invention relates to an ink-jet recording apparatus that includes a recording head for ejecting ink droplets through nozzle openings in response to a print signal, and an ink cartridge used to supply ink to the recording head.

BACKGROUND OF THE INVENTION

An ink-jet recording apparatus, which includes a recording head and an ink cartridge used to supply ink to the recording head, is so designed that a supply port is formed in the ink cartridge and that, to supplement the supply of ink, the ink cartridge is inserted into or removed from an ink supply needle that communicates with the recording head.

As is shown in FIG. 13, an ink supply needle A is so designed that a filter chamber D is formed by opening a joint area using an ink supply path C that communicates with a recording head B, and that air bubbles, which are generated or have grown in an ink cartridge, or dust, are captured at the filter E and are prevented from flowing into the recording head B.

However, for a recording head for which light colored inks are employed to improve the color print quality, the space around the recording head must be relatively narrow in order for at least six colored inks to be supplied to the recording head, and accordingly, the diameter of the ink needle A must be reduced. As a result, an air bubble F is formed that remains stagnant inside the ink supply needle A and interrupts the supply of ink to the recording head B.

In addition, when a recording head having multiple nozzle openings is employed to increase the recording density and the print quality, the dimensions of the filter E must be increased and the flow path resistance must be reduced in order to smoothly supply a large volume of ink to the recording head. Accordingly, a large space is produced upstream of the filter member, so that the flow rate of ink is reduced there and air bubbles are not discharged. These air bubbles stick to the filter member and increase the flow path resistance. And as a result, they interrupt the supply of ink to the recording head.

Further, when a large air bubble F enters the filter chamber D during the ink loading process, the air bubble F adversely affects the flow if ink, and the difference in the pressures between the upstream and the downstream sides of the filter E is increased.

In particular, for a recording head in which ink carried by a single supply needle branches off to a plurality of ink supply paths C and supplies ink to a plurality of nozzle openings, if the internal face of the filter chamber D is not kept uniformly wet, ink will flow across a wetter portion, and will form an ink flow induction path. Then, when the induction path is so positioned that it can easily communicate with the ink supply path C, if ink flows to the ink supply path C before the filter chamber D is completely filled, the air bubble F will remain in the filter chamber D, regardless of the attraction exerted by the ink, and will be difficult to discharge.

DISCLOSURE OF THE INVENTION

An ink-jet recording apparatus according to the present invention comprises:

a recording head for receiving ink supplied via a first ink supply path and for ejecting ink droplets;

a second ink supply path along which ink is transmitted from an ink cartridge to the first ink supply path; and a filter which is located at a joint area that forms a communication portion situated between the first ink supply path and the second ink supply path, wherein ink induction paths are formed at the joint area on the side of the second ink supply path in order to use capillary attraction to induce the flow of ink through the filter.

It is, therefore, one objective of the present invention to provide an ink-jet recording head, wherein the flow of ink to a recording head is not disturbed by air bubbles that are generated during the loading of ink, and wherein ink can be supplied to the recording head while at the same time air bubbles are removed.

DETAILED DESCRIPTION OF THE PREFERRED EMBODIMENTS

Figure 1:
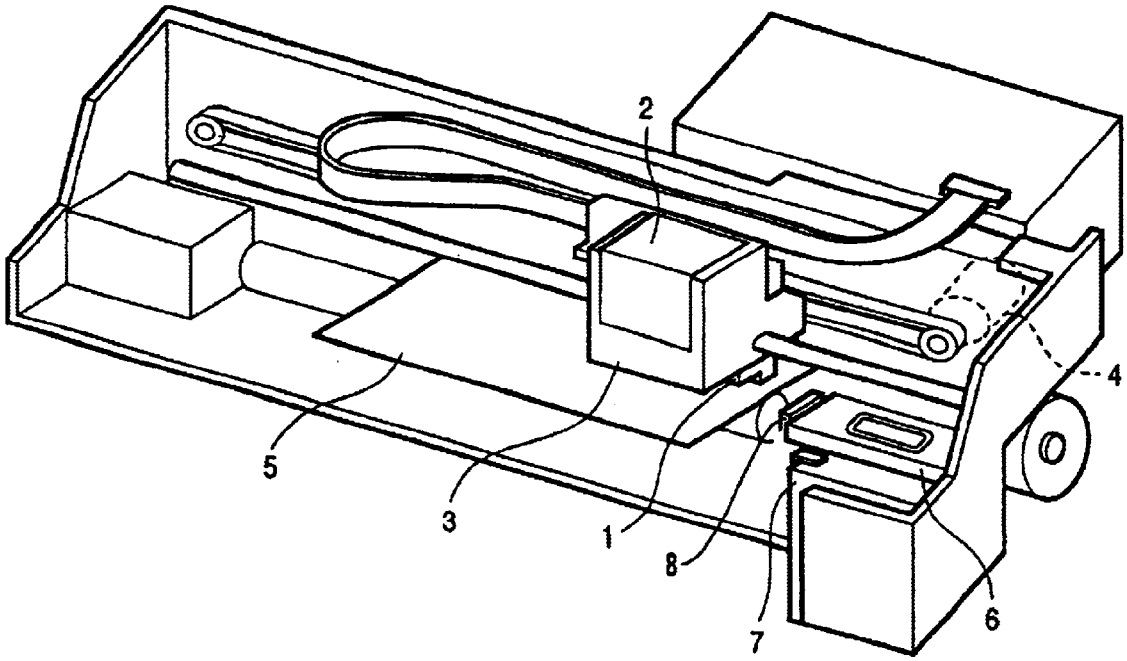
FIG. 1 is a diagram illustrating an ink-jet recording apparatus according to one embodiment of the present invention.

The embodiments of the present invention will now be described in detail while referring to the drawings.

In FIG. 1 is shown an ink-jet recording apparatus according to one embodiment of the present invention. A recording head 1 for ejecting ink droplets upon receiving a print signal is mounted on a carriage 3 with an ink cartridge 2. The recording head 1 is moved along the width of a recording sheet 5 by a carriage drive motor 4, and ejects ink droplets through nozzle openings. Further, the recording head 1 receives a volume of ink, equivalent to the volume used for printing, from the ink cartridge 2 along an ink flow path that will be described later.

A capping unit 6, which is provided in a non-printing area, seals the recording head 1 to prevent the nozzle openings from drying out, and negative pressure produced by a suction pump 7 is applied in order to remove clogging at the nozzle openings, or to load ink in a replacement ink cartridge 2. A cleaning member 8 is also provided.

Figure 2:
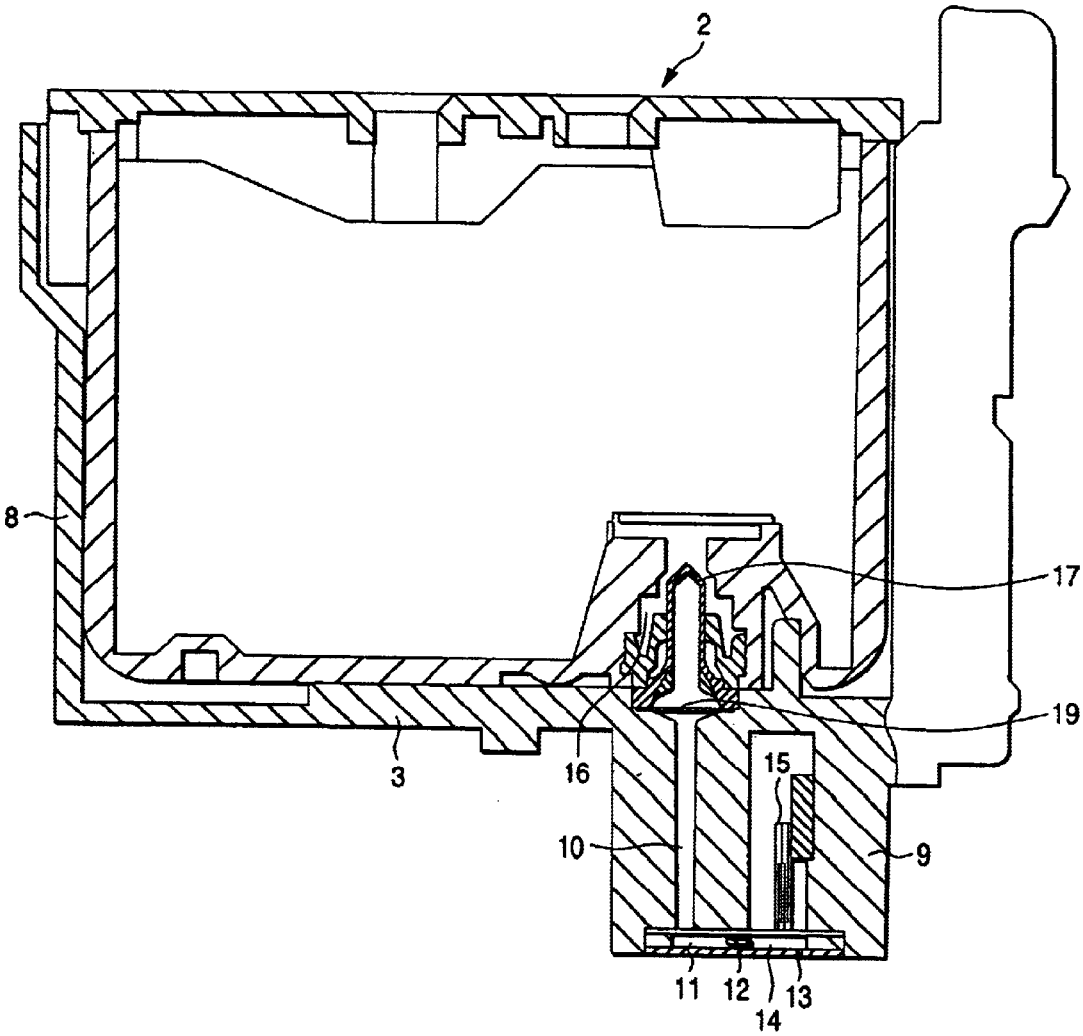
FIG. 2 is a cross-sectional view of the connection of the ink cartridge and the recording head of the ink-jet recording apparatus.

In FIG. 2 is shown an example arrangement for the recording head 1 and the ink cartridge. A cartridge holder 8 is located on the top of the carriage 3, while a head holder 9 is fixed to the bottom in order to secure the recording head 1.

The recording head 1 comprises: a reservoir 11, to which ink is supplied via a first ink supply path 10 that is provided by forming a through hole in the head holder 9; a pressure generating chamber 14, to which ink is supplied from the reservoir 11 via the ink supply port 12 for the ejection of ink droplets through a nozzle opening 13; and pressure means 15 for pressurizing the pressure generating chamber 14.

Figure 3:
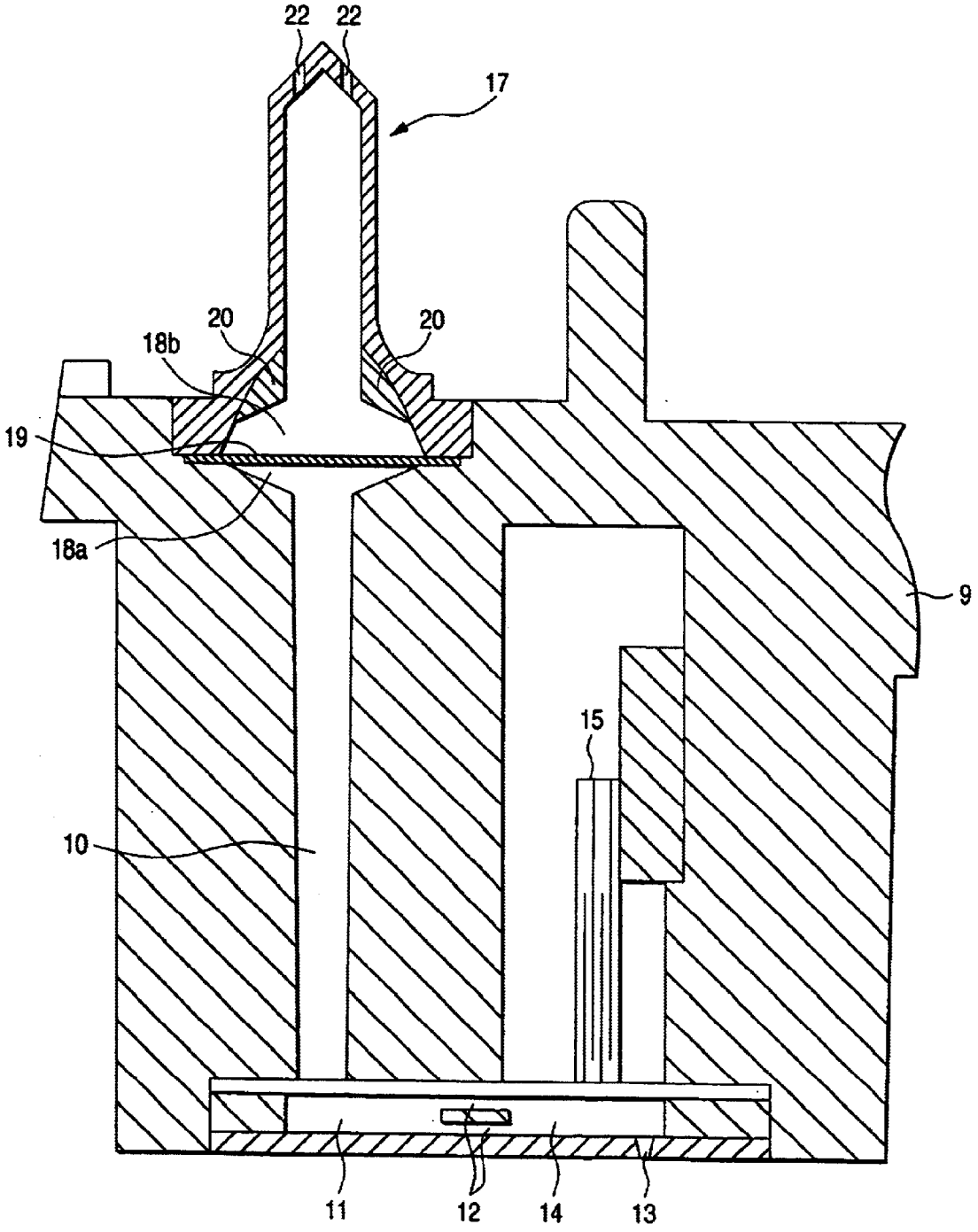
FIG. 3 is an enlarged cross-sectional view of the area at the filter chamber in the recording head of the ink-jet recording apparatus.

As is shown in FIG. 3, an ink supply needle 17 is provided upright on the face of the carriage opposite the ink cartridge, and serves as a second ink supply path that communicates with an ink supply port 16 of the ink cartridge 2.

Filter chambers 18*a* and 18*b* are defined at a joint area in the first ink supply path 10 and the ink supply needle 17, so that a boundary is set in the direction of the opening. A filter 19 extends across the joint area to remove air bubbles and dust from the ink.

Figure 4:
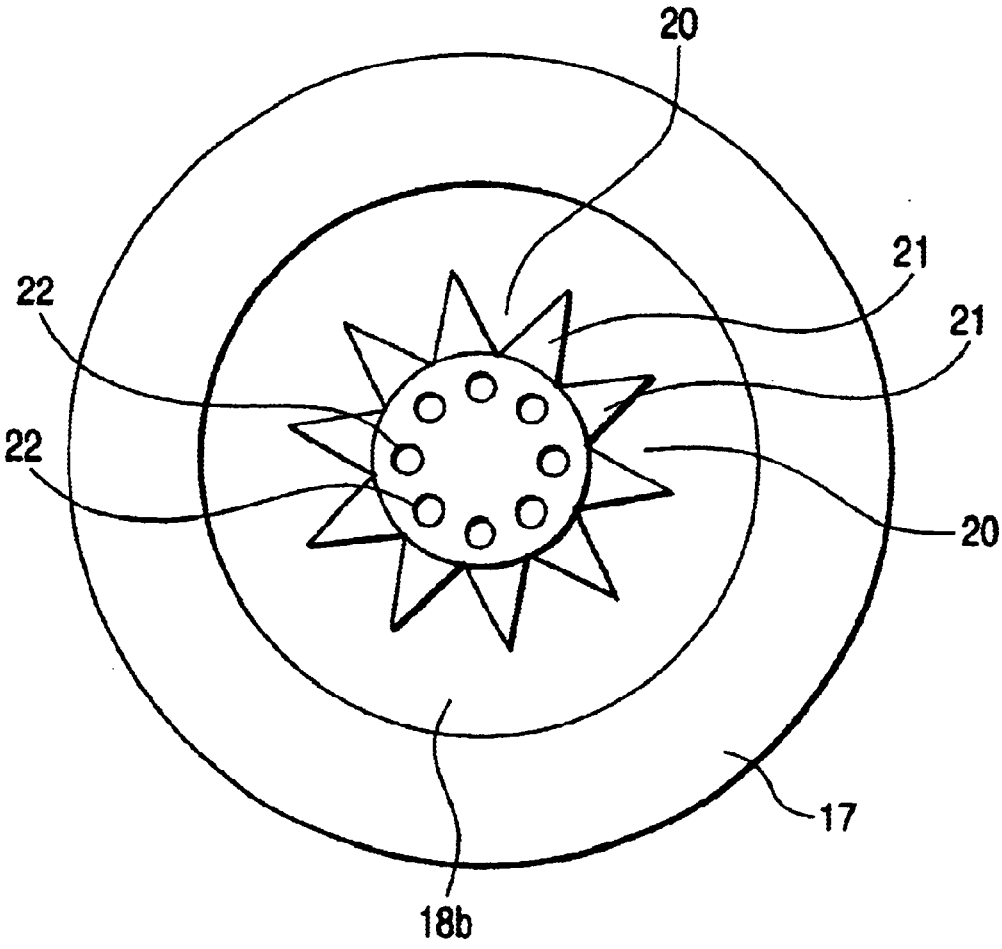
FIG. 4 is an enlarged bottom view of the second ink supply path of the ink-jet recording apparatus.

A plurality of projections 20, the distal ends of which extend inward toward the center, as is shown in FIG. 4, are radially located at pitches at which grooves 21, along which the movement of ink can be induced using capillary attraction, can be formed. Reference numeral 22 denotes ink induction holes through which ink is drawn from the ink cartridge 2 to the ink supply needle 17.

In this embodiment, the ink supply port 16 of the ink cartridge 2 is inserted into the ink supply needle 17, and the recording head 1 is sealed by the capping unit 6 to apply the negative pressure provided by the suction pump 6. Then, ink from the ink cartridge 2 flows through the ink induction holes 22 and the filter chambers 18*b* and 18*a* to the recording head 1, and air bubbles that become stagnant along the flow path that extends from the ink cartridge 2 to the nozzle opening 13 are discharged to the outside with ink.

When the ink filling job following the exchange of the ink cartridge is completed in this manner, and a drive signal is transmitted to the recording head 1, ink droplets are ejected from the recording head 1. As the pressure on the recording head side is reduced due to the ejection of the ink droplets, ink from the ink cartridge 2 flows into the recording head 1 in a volume equivalent to that used for the printing.

Figure 5:
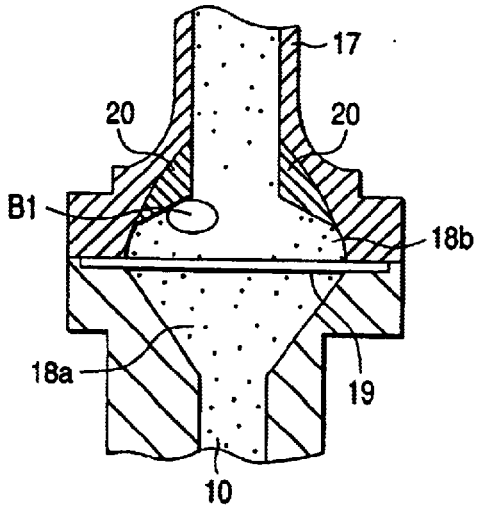
FIGS. 5(*a*) to 5(*d*) are diagrams showing the movement of an air bubble in the filter chamber during printing performed by the ink-jet recording apparatus.
Figure 5:
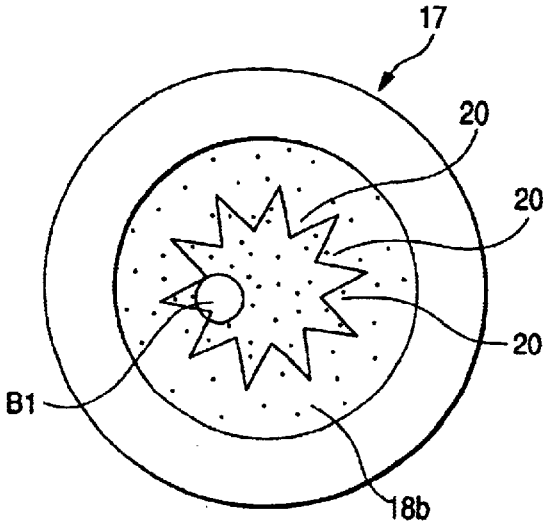
Figure 5:
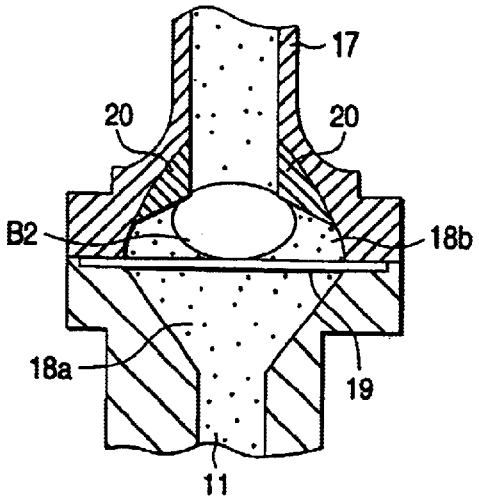
Figure 5:
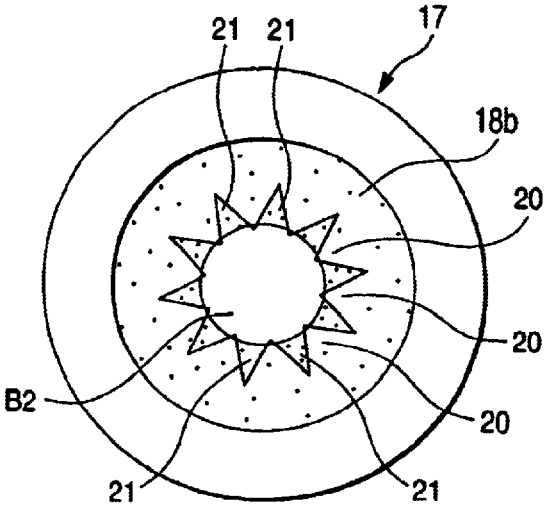

On the other hand, as is shown in FIGS. 5(*a*) and 5(*b*), when an air bubble B1 produced in the ink cartridge enters the ink supply needle 17 at the time the ink cartridge is mounted, or during printing, as the air bubble B1 can not pass through the filter 19, it stagnates in the upper filter chamber 18*b* and sticks to the projections 20.

When the air bubble B1 that is captured by the projections 20 has grown into a large air bubble B2, it is held by the distal ends 20*a* of the projections 20, as is shown in FIGS. 5(*c*) and 5(*d*). Since even in this state a plurality of grooves 21 that are formed between the projections 20 are still filled with ink, capillary attraction at the grooves 21 causes the ink to flow to the filter chambers 18*b* and 18*a*. Therefore, the volume of ink that is required for printing can be supplied to the recording head, and printing can be continued, regardless of whether stagnation of air bubbles occurs.

When clogging occurs in the recording head 1 because printing has been continued for an extended period of time, the recording head 1 is sealed by the capping unit 6 and negative pressure is applied to the entire flow path. Then, ink in the ink cartridge 2 quickly flows through the ink induction hole 22 to the filter chambers 18*b* and 18*a*. The fast ink flow draws, to the filter 19, the air bubble B2 that has been captured by the projections 20, and the bubble B2 is reduced to small pieces that in turn are drawn to the recording head and discharged to the capping unit 6 through the nozzle openings 13.

Figure 6:
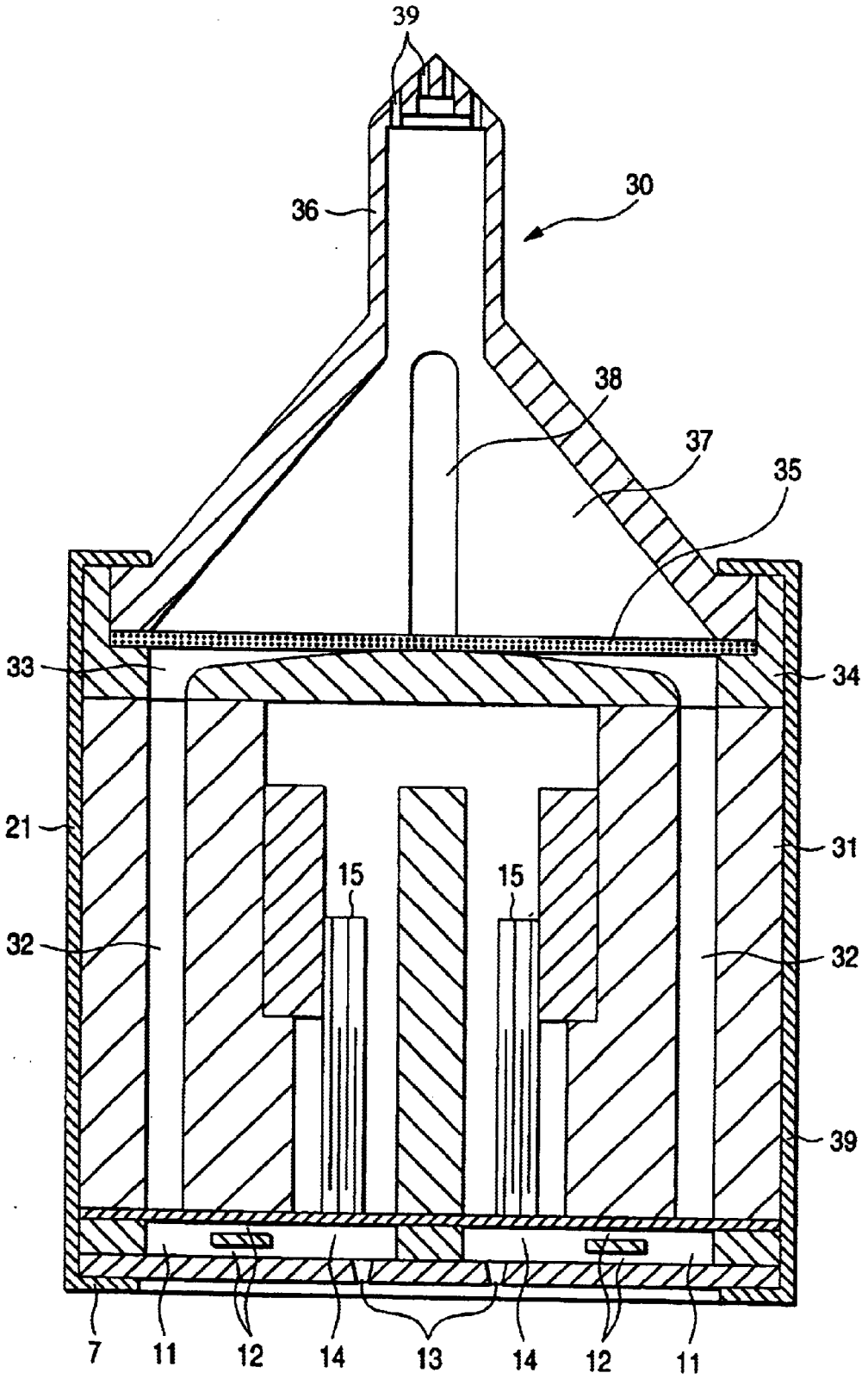
FIG. 6 is a diagram illustrating another example recording head used for the ink-jet recording apparatus of the present invention.

In FIG. 6 is shown another embodiment of the present invention, wherein ink is supplied through a single ink supply needle 30 to a plurality of first ink supply paths 32 in a head holder 31.

A filter chamber formation member 34 is fixed to the top of the head holder 31, and communicates with the ink inlets for the first ink supply paths 32 and forms a recessed portion that serves as a filter chamber 33. A filter 35 is disposed horizontally across the filter chamber 33, and the ink supply needle 30 is mounted on the filter 35 to form the second ink supply path.

Figure 7:
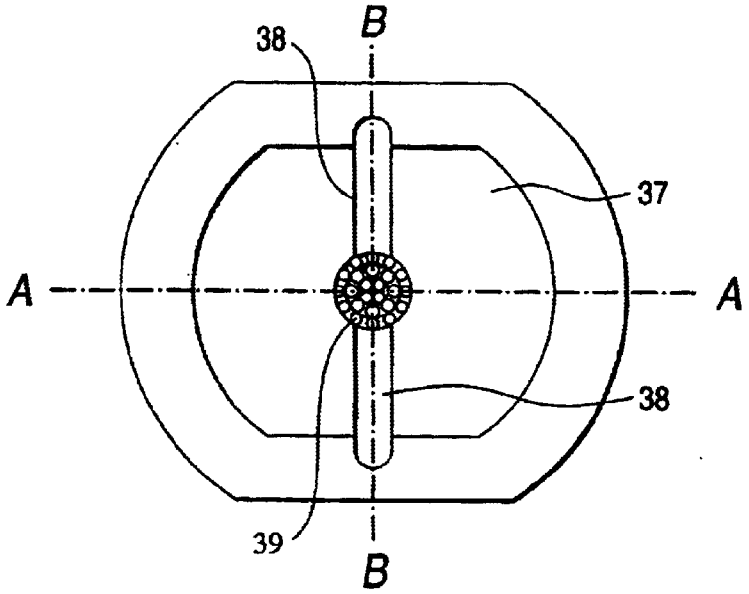
FIGS. 7(*a*) to 7(*c*) are a bottom view of an example ink supply needle for the ink-jet recording apparatus and cross-sectional views taken along lines A—A and B—B.
Figure 7:
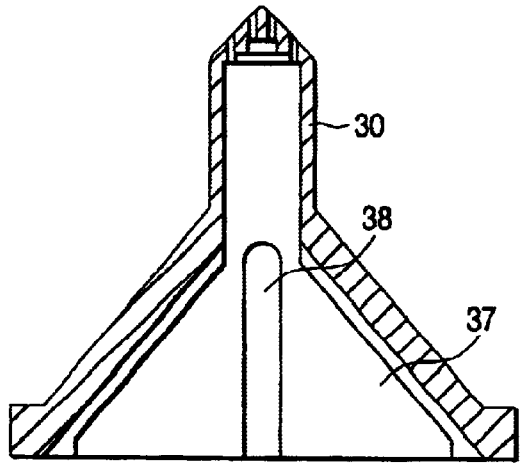
Figure 7:
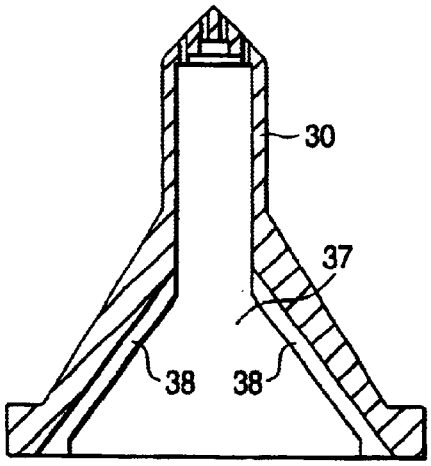

The ink supply needle 30 is constituted by an insertion portion 36 that has a needle-shaped tip, and a funnel-shaped filter chamber 37 below that is opened up to cover the two second ink supply paths 32. As is shown in FIGS. 7(*a*)–7(*c*), grooves 38 are formed in the internal face of the filter chamber 37 and are extended from the vicinity of the lower end of the insertion portion 36 to portions that are distant from the ink supply paths 32, preferably, in this embodiment, the middle portion of the area whereat paths 32. Reference number 39 denotes an ink induction hole; and 36, a fixed frame.

In this embodiment, before being used, the ink cartridge 2 is mounted, the recording head 1 is sealed by the capping unit 2, and the suction pump 7 is driven to apply negative pressure to the recording head 1 and thereby initiate the loading of ink.

Figure 8I:
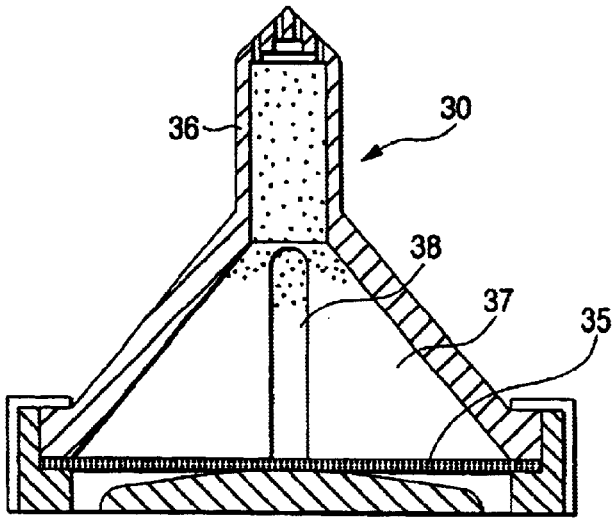
FIGS. 8(I) to 8(III) are diagrams showing the flow of ink in the filter chamber of the ink-jet recording apparatus during the loading of ink.
Figure 8:
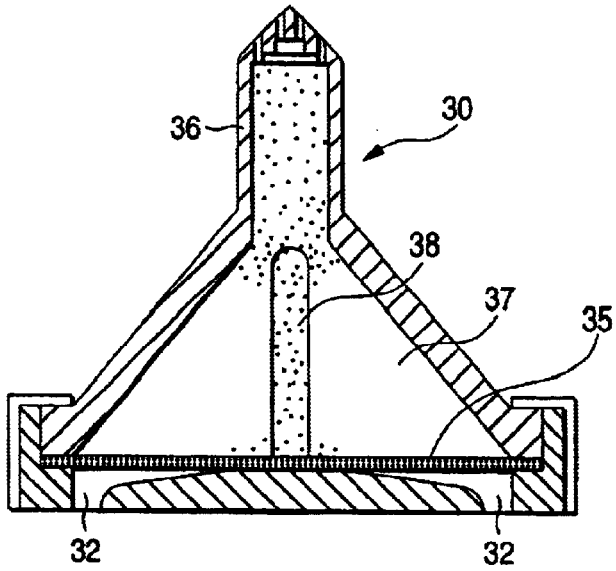
Figure 8:
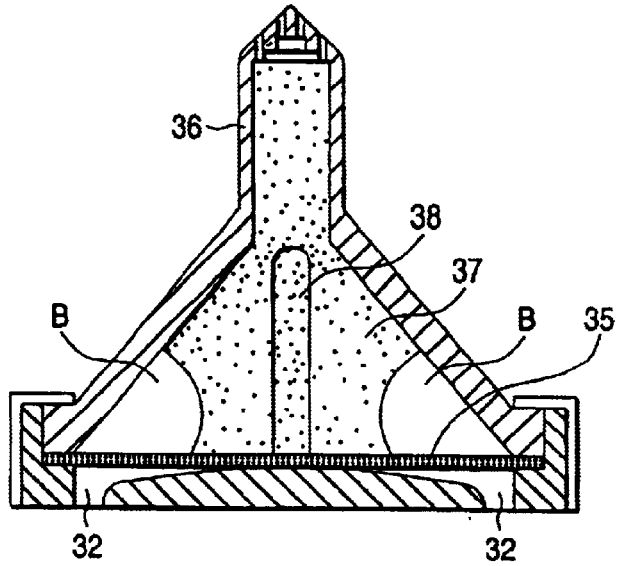

This negative pressure is applied to the ink supply needle 16 via the nozzle opening 13, the pressure generation chamber 14, the ink supply port 12, the reservoir 11 and the first ink supply path 32, and ink in the ink cartridge 2 is drawn into the insertion portion 36 of the ink supply needle 30. The ink, which has entered from the insertion portion 36, is attracted along the grooves 38 that are positioned below the insertion portions 36 by capillary attraction (FIG. 8(I)). While ink is wetting the grooves 38 and their peripheral area, the ink reaches the filter 35 and first wets one part of the area that is farthest from the second ink supply paths 32 (FIG. 8(II)). When the attraction of the ink is continued and the negative pressure applied to the entire flow path is increased, there is a rapid, large flow of ink into the filter chamber 37 along the grooves 38 that serve as induction paths. The ink drives the air in the filter chamber 37, or the air bubble B, toward the ink supply path, and gradually expands the area it occupies (FIG. 8(III)).

Since the negative pressure produced by the suction pump 7 is applied to the second ink supply paths 32, the air, or the air bubble B, that is driven out of the filter chamber 37 is induced to move along the second ink supply path 32 and is discharged from the nozzle openings 13 in the recording head 1 to the capping unit 6.

Figure 9:
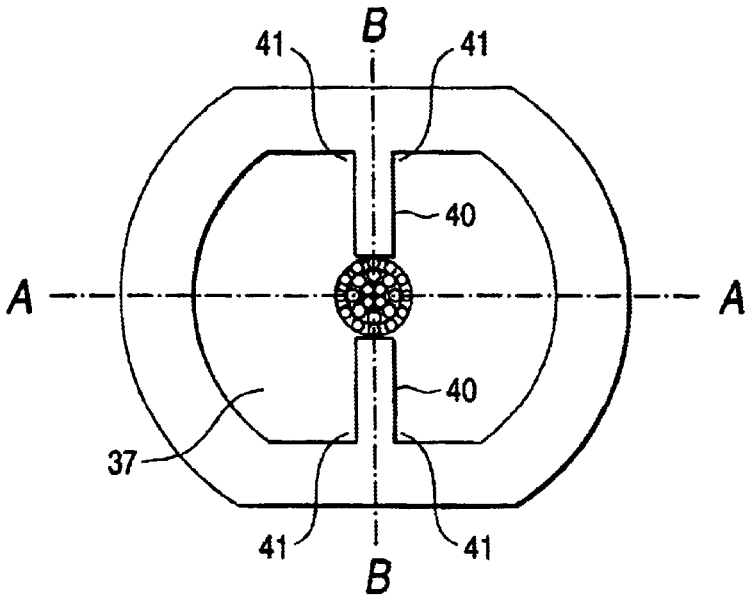
FIGS. 9(*a*) to 9(*c*) are a bottom view of another example ink supply needle and cross-sectional views taken along lines A—A and B—B.
Figure 9:
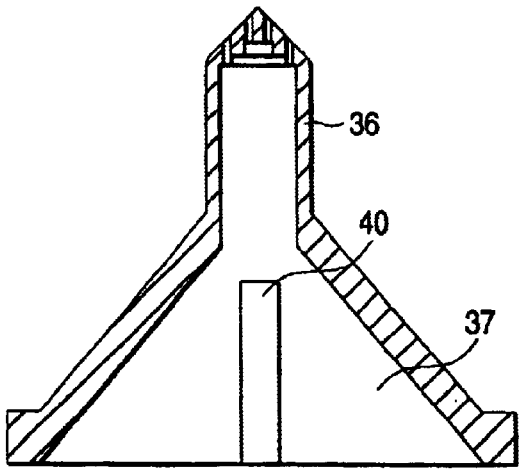
Figure 9:
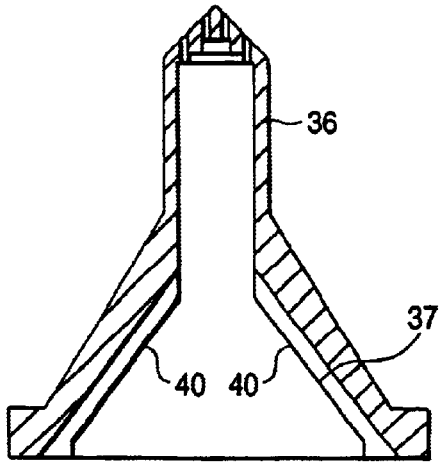

In FIG. 9 is shown an additional embodiment of the present invention, where ribs 40 are extended from the vicinity of the lower end of the insertion portion 36 to the area that is distant from the ink supply paths 32, preferably, the middle position located between the ink supply paths 32.

In this embodiment, capillary attraction at gaps 41 that are defined by the sides of the ribs 40 and the internal face of a filter chamber 38 is applied to the ink. Therefore, when the ink is initially loaded, it is induced to move along both faces of the ribs 40 to the area that is distant from the ink supply paths 32, and air is driven out of the isolated area through the ink supply paths 32 and is discharged from the filter chamber 37.

Figure 10:
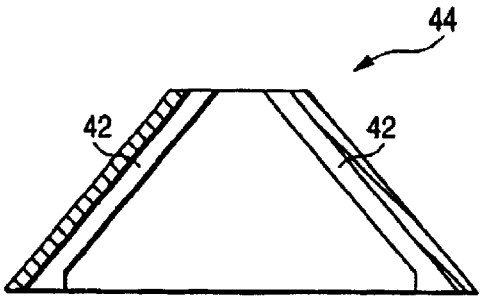
FIGS. 10(*a*) to 10(*d*) are cross-sectional views of an additional example ink supply needle.
Figure 10:
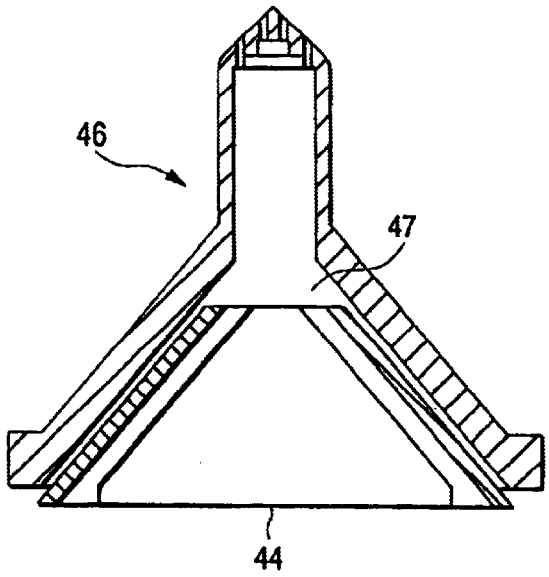
Figure 10:
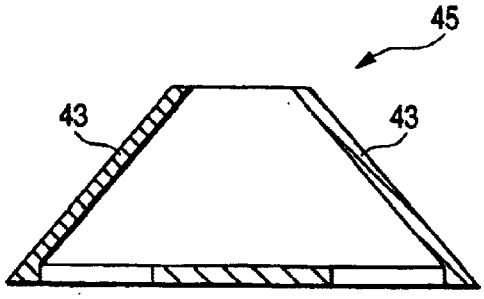
Figure 10:
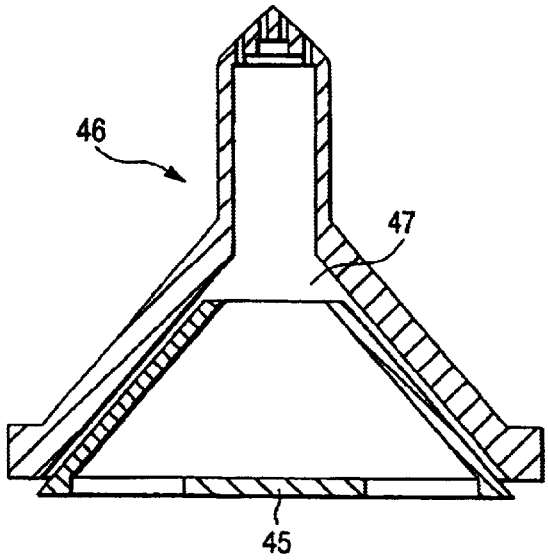

In the above embodiments, the grooves 38 or the ribs 40 are integrally formed with the filter chamber 37 of the ink supply needle 30. However, apparently the same effects can be produced when, as is shown in FIG. 10(*b*) or 10(*d*), a member 44 or 45 in which grooves 42 or ribs 43 are formed, as is shown in FIG. 10(*a*) or 10(*c*), is mounted in a filter chamber 47 of an ink supply needle 46.

According to the above embodiments, the speed at which ink is loaded can be improved, and the removal of air bubbles can be facilitated, without the mold for the manufacture of the ink supply needle being changed.

In addition, in the above embodiments, the ink induction paths are formed so that they are positioned around the circumferential face of the filter chamber. However, the same effect can also be obtained when, as is shown in FIG. 11(*a*) or 11(*b*), an induction member 49 that extends inward to the center of a filter 35 is coaxially formed with an ink supply needle 48.

Figure 11:
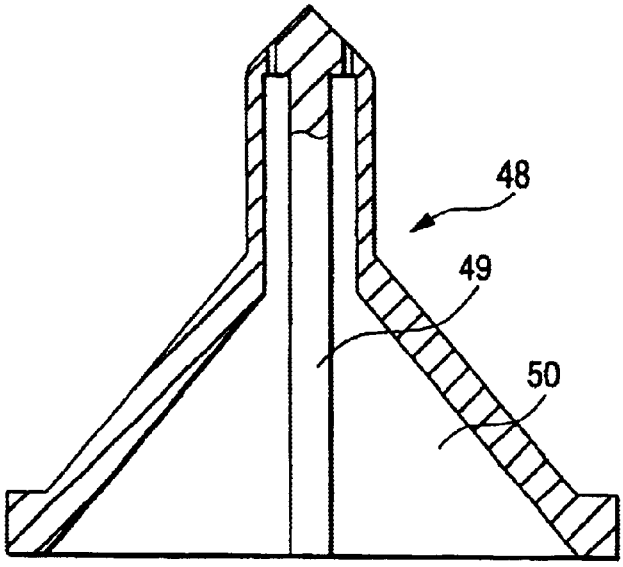
FIGS. 11(*a*) and 11(*b*) are a cross-sectional view and a perspective view of another embodiment of the present invention.
Figure 11:
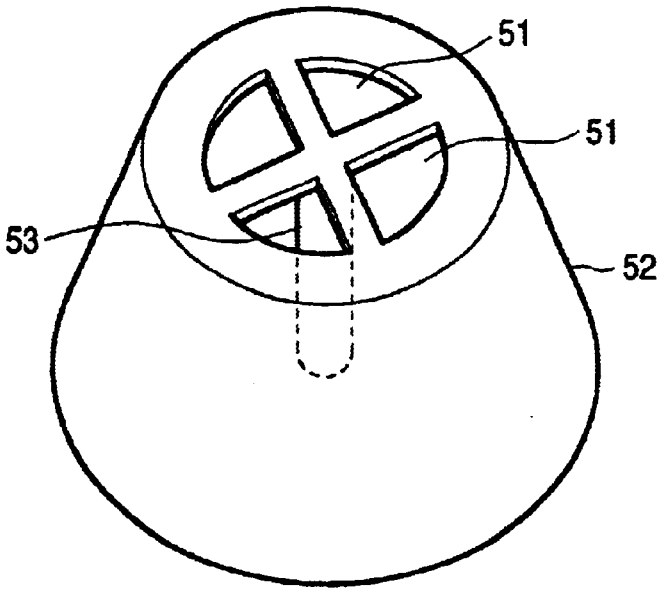

Specifically, in the example in FIG. 11(*a*), the induction member 49 is integrally formed with the ink supply needle 48, and in the example in FIG. 11(*b*), a rod-shaped induction member 53 is formed along the center line of a member or holder 52 that can be mounted in a filter chamber 50 and that has ink flow windows 51. The lengths of the induction members 49 and 53 are so adjusted that their lower ends substantially contact the filter 35 in order to spread the ink out across the surface of the filter 35.

According to these examples, the ink that has entered the ink supply needle 48 is guided to the surface of the induction member 49 or 53 and wets the center portion of the filter 35 first that distant from the ink supply paths 32. Therefore, as well as in the previous embodiments, the ink can be loaded while air bubbles are removed.

Figure 12:
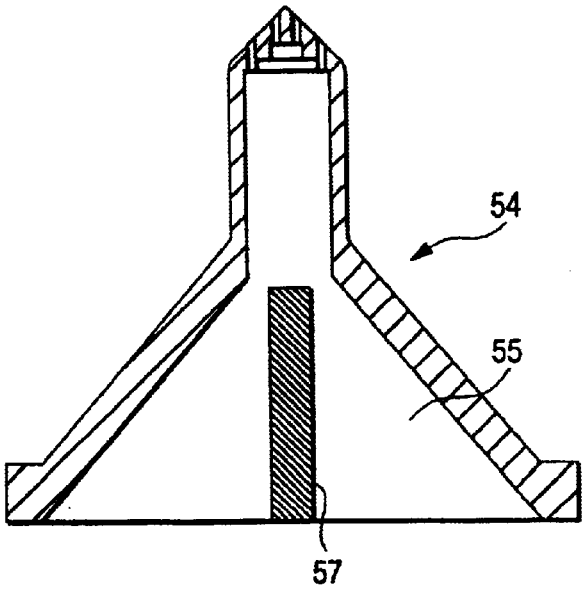
FIGS. 12(*a*) and 12(*b*) are cross-sectional views of an additional embodiment of the present invention.
Figure 12:
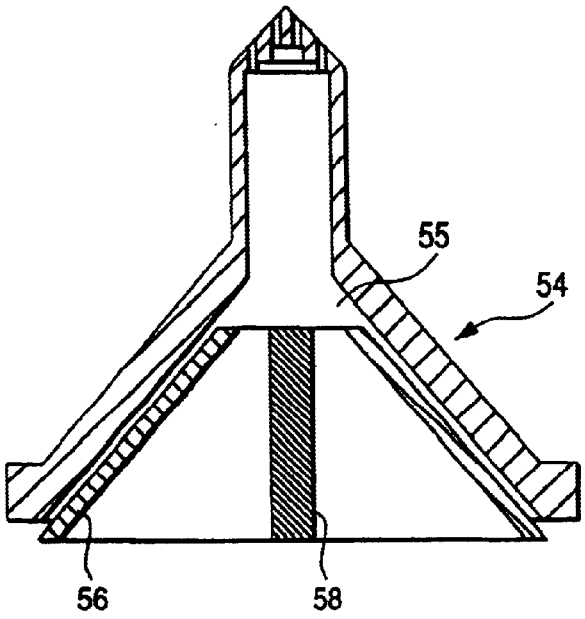
Figure 13:
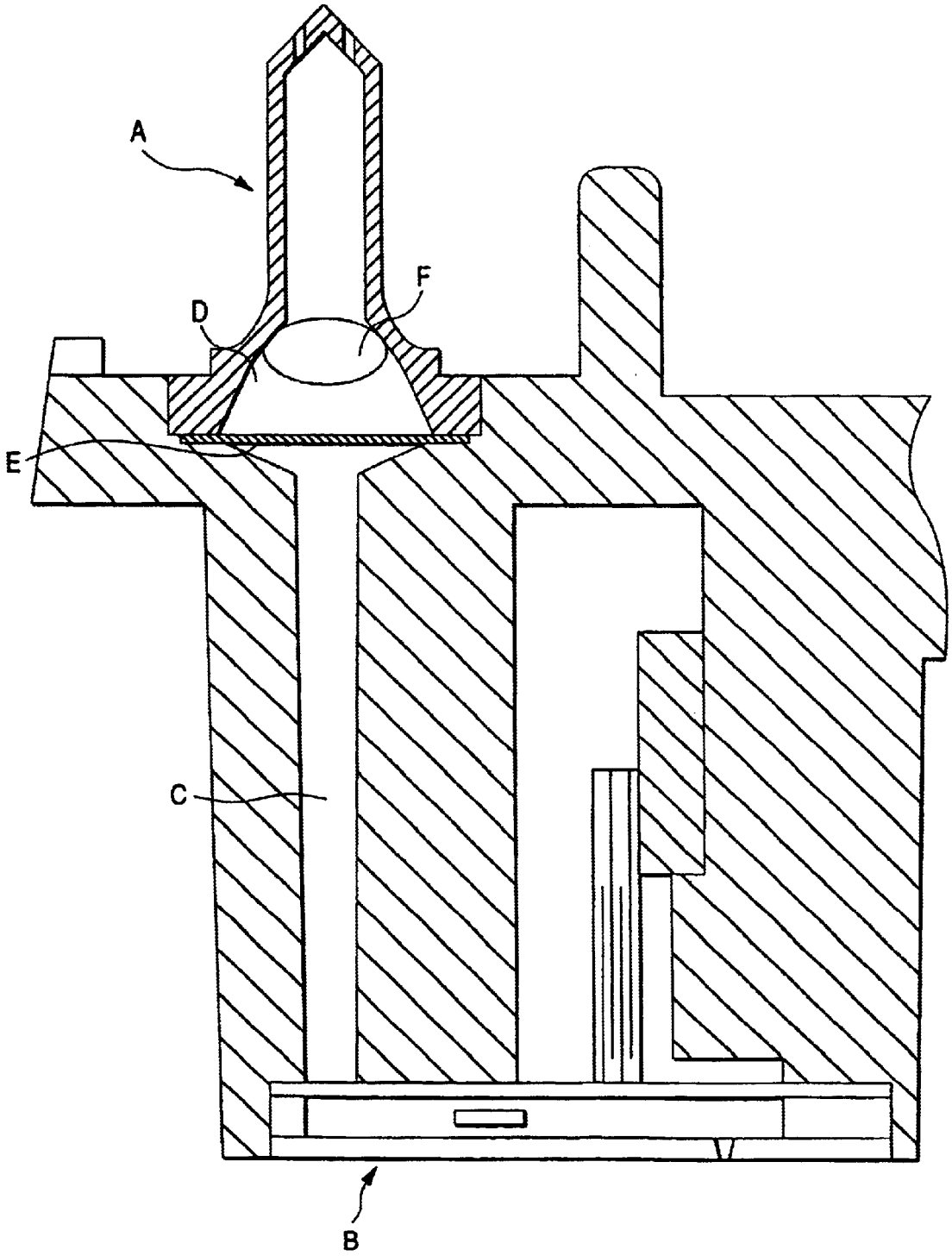
FIG. 13 is a diagram of a conventional ink supply needle for explaining a phenomenon which occurs when the supply of ink to a recording head is deteriorated due to an air bubble.

Furthermore, according to the embodiments, the movement of ink is induced by capillary attraction that is exerted at the gaps between the grooves or the ribs, and the internal faces whereat they are formed. However, the same effect can also be obtained when a belt-shaped layer 57 or 58 of medicine that has an affinity to ink is formed vertically on the inner circumferential face of a filter chamber 55 of an ink supply needle 54 as is shown in FIG. 12(*a*), or vertically on the inner circumferential face of a member 56 that is located in the filter chamber as is shown in FIG. 12(*b*).

In the above embodiments, an explanation has been given for a case where two ink induction paths are formed. It is, however, apparent that the same effect can be acquired with one ink induction path or with three or more induction paths. Further, in the above embodiments, a recording head is employed wherein the ink supply paths are constituted by through holes that are formed in the head holder. However, apparently the same effect can be obtained when the present invention is applied to a recording head where ink supply paths are formed in different members, such as tubes.

INDUSTRIOUS USABILITY

As is described above, according to the present invention, regardless of the presence of an air bubble, the supply of ink to the recording head is ensured by ink induction means that is formed upstream of the filter, and the a volume of ink required for printing can be steadily supplied to the recording head.

What is claimed is:

1. An ink-jet recording apparatus comprising:

a recording head for receiving ink supplied via a first ink supply path and for ejecting ink droplets;

a second ink supply path along which ink is transmitted from an ink supply to said first ink supply path, wherein said ink is transmitted in said second ink supply path generally in an ink transfer direction from said ink supply to said first ink supply path, wherein said second ink supply path comprises a connection portion that receives said ink from said ink supply and comprises an enlarged portion, and wherein a cross-sectional area of said enlarged portion, which is substantially perpendicular to said ink transfer direction, is greater than a cross-sectional area of said connection portion, which is substantially perpendicular to said ink transfer direction; and a filter which is located at a joint area that forms a communication portion situated between said first ink supply path and said second ink supply path, wherein said enlarged portion comprises at least a portion of said joint area, wherein ink induction paths are formed in said enlarged portion in order to use capillary attraction to induce the low of ink through said filter, and wherein said enlarged portion is tapered such that said cross-sectional area of said enlarged portion gradually changes along said ink transfer direction from said second ink supply path to said first ink supply path.

2. An ink-jet recording apparatus according to claim 1, wherein said ink induction paths are constituted by projections that are radially formed at small pitches so as to capture an air bubble.

3. An ink-jet recording apparatus according to claim 1, wherein grooves are formed between said adjacent projections in order to supply ink to said filter using capillary attraction.

4. An ink-jet recording apparatus according to claim 1, wherein said ink induction paths are extended to an area that does not face said first ink supply path.

5. An ink-jet recording apparatus according to claim 4, wherein said ink induction paths are integrally formed with said enlarged portion.

6. An ink-jet recording apparatus according to claim 4, wherein said ink induction paths are formed by mounting a groove formation member in said enlarged portion.

7. An ink-jet recording apparatus according to claim 6, wherein said groove formation member comprises rigid grooves.

8. An ink-jet recording apparatus according to claim 4, wherein said ink induction paths are formed so as to be coaxial with said second ink supply path.

9. An ink-jet recording apparatus according to claim 8, wherein said ink induction paths do not contact an inner wall of said enlarged portion.

10. An ink jet recording apparatus according to claim 8, wherein said ink induction paths are disposed substantially in a center of said cross-section of said enlarged portion.

11. An ink-jet recording apparatus according to claim 4, wherein said ink induction paths include a layer having an affinity to ink.

12. An ink-jet recording apparatus according to claim 1, wherein said ink induction paths are formed at positions that are farthest from said first ink supply path in said cross-sectional area of said enlarged portion.

13. An ink-jet recording apparatus according to claim 1, wherein said ink induction paths are formed as grooves.

14. An ink-jet recording apparatus according to claim 1, wherein said ink induction paths are formed as ribs.

15. An ink-jet recording apparatus according to claim 1, wherein said enlarged portion is contiguous with said connection portion and is tapered in shape.

16. An ink-jet recording apparatus according to claim 1, wherein said cross-sectional area of said enlarged portion gradually increases along said ink transfer direction from said second ink supply path to said first ink supply path.

17. An ink-jet recording apparatus comprising:

a recording head for receiving ink supplied via a first ink supply path and for ejecting ink droplets;

a second ink supply path along which ink is transmitted from an ink supply to said first ink supply path, wherein said ink is transmitted in said second ink supply path generally in an ink transfer direction from said ink supply to said first ink supply path, wherein said second ink supply path comprises a connection portion that receives said ink from said ink supply and comprises an enlarged portion, and wherein a cross-sectional area of said enlarged portion, which is substantially perpendicular to said ink transfer direction, is greater than a cross-sectional area of said connection portion, which is substantially perpendicular to said ink transfer direction; and a filter which is located at a joint area that forms a communication portion situated between said first ink supply path and said second ink supply path, wherein said enlarged portion comprises at least a portion of said joint area, wherein ink induction paths are formed in said enlarged portion in order to use capillary attraction to induce the flow of ink through said filter, wherein said ink induction paths are extended to an area that does not face said first ink supply path, and wherein said ink induction paths are formed by mounting a rib formation member in said enlarged portion.

18. An ink-jet recording apparatus comprising:

a recording head for receiving ink supplied via a first ink supply path and for ejecting ink droplets;

a second ink supply path along which ink is transmitted from an ink supply to said first ink supply path, wherein said ink is transmitted in said second ink supply path generally in an ink transfer direction from said ink supply to said first ink supply path, wherein said second ink supply path comprises a connection portion that receives said ink from said ink supply and comprises an enlarged portion, and wherein a cross-sectional area of said enlarged portion, which is substantially perpendicular to said ink transfer direction, is greater than a cross-sectional area of said connection portion, which is substantially perpendicular to said ink transfer direction; and a filter which is located at a joint area that forms a communication portion situated between said first ink supply path and said second ink supply path, wherein said enlarged portion comprises at least a portion of said joint area, wherein ink induction paths are formed in said enlarged portion in order to use capillary attraction to induce the flow of ink through said filter, wherein said ink induction paths are extended to an area that does not face said first ink supply path, and wherein said ink induction paths are formed in a holder that is mounted in said enlarged portion, said holder including a rod-shaped member that is positioned coaxially with said second ink supply path.

19. An ink-jet recording apparatus comprising:

a recording head for receiving ink supplied via a first ink supply path and for ejecting ink droplets;

a second ink supply path along which ink is transmitted from an ink cartridge to said first ink supply path; and a filter which is located at a joint area that forms a communication portion situated between said first ink supply path and said second ink supply path, wherein ink induction paths are formed at said joint area adjacent to said second ink supply path in order to use capillary attraction to induce the flow of ink through said filter, and said ink induction paths are extended from an ink inlet of said second ink supply path, and wherein said joint area is tapered such that a cross-sectional area of said joint area gradually changes along a direction from said second ink supply path to said first ink supply path.

20. An ink supply passage structure for supplying ink from an ink cartridge to a recording head, comprising:

a first ink supply path having a first open end, wherein said first ink supply path axially terminates at the first open end;

a second ink supply path connected to and extending from the first open end to be communicated with the first ink supply path, wherein the second ink supply path is at least as large in cross sectional area as the first ink supply path, and the first open end of the first ink supply path forms an axial terminus of the second ink supply path; and a protrusion and/or groove axially provided to the second ink supply path, wherein the protrusion and/or groove axially extends along the second ink supply path and axially terminates at the first open end of the first ink supply path, wherein the first ink supply path axially terminates at a longitudinal axis of the first ink supply path, wherein the longitudinal axis of the first ink supply path is substantially parallel to a longitudinal axis of the second ink supply path, and wherein the first ink supply path is located upstream of the second ink supply path in a direction in which ink is supplied from the ink cartridge to the recording head.

21. An ink supply passage structure according to claim 20, wherein a portion of the second ink supply path containing the protrusion and/or groove is in the form of a conical chamber.

22. An ink supply passage structure according to claim 20, wherein a plurality of protrusions are arranged along an inner circumference of the second ink supply path so that an ink induction path is formed between each adjacent pair of protrusions.

23. An ink supply passage structure according to claim 20, wherein a plurality of grooves are arranged along an inner circumference of the second ink supply path so that each of the grooves forms an ink induction path.

24. An ink supply passage structure according to claim 20, wherein the protrusion is formed of material having ink affinity.

25. The ink supply passage structure according to claim 20, wherein the second ink supply path has a cross-sectional area which is larger than that of the first ink supply path.

26. An ink supply passage structure comprising:

a first ink supply path having a first open end, wherein said first ink supply path axially terminates at the first open end;

a second ink supply path connected to and extending from the first open end to be communicated with the first ink supply path, wherein the second ink supply path has a cross sectional area larger than that of the first ink supply path, and wherein the first open end of the first ink supply path forms an axial terminus of the second ink supply path; and a protrusion and/or groove axially provided to the second ink supply path, wherein the protrusion and/or groove is contiguous to at least the first open end of the first ink supply path, wherein the first ink supply path axially terminates at a longitudinal axis of the first ink supply path, wherein the longitudinal axis of the first ink supply path is substantially parallel to a longitudinal axis of the second ink supply path, and wherein the protrusion and/or groove axially extends from the second ink supply path, across the first open end, and into the first ink supply path, wherein the first ink supply path is located upstream of the second ink supply path with respect to a direction in which ink is supplied from the ink cartridge to the recording head.

27. An ink supply passage structure comprising:

a first ink supply path having a first open end, wherein said first ink supply path axially terminates at the first open end;

a second ink supply path connected to and extending from the first open end to be communicated with the first ink supply path, wherein the second ink supply path is at least as large in cross sectional area as the first ink supply path, and the first open end of the first ink supply path forms an axial terminus of the second ink supply path;

a protrusion and/or groove axially provided to the second ink supply path, wherein the protrusion and/or groove is contiguous to at least the first open end of the first ink supply path, wherein the first ink supply path axially terminates at a longitudinal axis of the first ink supply path, and wherein the longitudinal axis of the first ink supply path is substantially parallel to a longitudinal axis of the second ink supply path; and a filter located at an opposite axial terminus of the second ink supply path, wherein said opposite axial terminus is opposite to and downstream from said axial terminus of the second ink supply path.

28. The ink supply passage structure according to claim 27, wherein the first ink supply path is located upstream of the second ink supply path with respect to a direction in which ink is supplied from the ink cartridge to the recording head.

29. The ink supply passage structure according to claim 27, wherein the second ink supply path has a cross-sectional area which is larger than that of the first ink supply path.

30. An ink supply passage structure comprising:

a first ink supply path having a first open end, wherein said first ink supply path axially terminates at the first open end;

a second ink supply path connected to and extending from the first open end to be communicated with the first ink supply path, wherein the second ink supply path has a cross sectional area larger than chat of the first ink supply path, and wherein the first open end of the first ink supply path forms an axial terminus of the second ink supply path; and a protrusion and/or groove axially provided to the second ink supply path, wherein the protrusion and/or groove is contiguous to at least the first open end of the first ink supply path, wherein the protrusion and/or groove axially extends from the second ink supply path, across the first open end of the first ink supply path, and into the first ink supply path, wherein the first ink supply path is located upstream of the second ink supply path with respect to a direction in which ink is supplied from the ink cartridge to the recording head.

31. An ink supply passage structure for supplying ink from an ink cartridge to a recording head, comprising:

a first ink supply path having a first open end, wherein said first ink supply path axially terminates at the first open end;

a second ink supply path connected to and extending from the first open end to be communicated with the first ink supply path, wherein the second ink supply path has a cross sectional area larger than that of the first ink supply path, and wherein the first open end of the first ink supply path forms an axial terminus of the second ink supply path; and a protrusion and/or groove axially provided to the second ink supply path, wherein the protrusion and/or groove axially extends along the second ink supply path and is contiguous to at least the first open end of the first ink supply path, wherein the first ink supply path axially terminates at a longitudinal axis of the first ink supply path, wherein the longitudinal axis of the first ink supply path is substantially parallel to a longitudinal axis of the second ink supply path, wherein the first ink supply path is located upstream of the second ink supply path in a direction in which ink is supplied from the ink cartridge to the recording head, and wherein the cross sectional area of the first ink supply path is substantially constant over an entire length of the first ink supply path.

* * * * *